US012017883B2

(12) United States Patent
Osakabe et al.

(10) Patent No.: US 12,017,883 B2
(45) Date of Patent: Jun. 25, 2024

(54) SHEET CONVEYING DEVICE AND IMAGE RECORDING APPARATUS

(71) Applicant: BROTHER KOGYO KABUSHIKI KAISHA, Nagoya (JP)

(72) Inventors: Yoshinori Osakabe, Seto (JP); Takashi Kitagawa, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 796 days.

(21) Appl. No.: 17/077,178

(22) Filed: Oct. 22, 2020

(65) Prior Publication Data

US 2021/0039906 A1 Feb. 11, 2021

Related U.S. Application Data

(63) Continuation of application No. PCT/JP2018/016964, filed on Apr. 26, 2018.

(51) Int. Cl.
*B65H 5/36* (2006.01)
*B65H 3/06* (2006.01)
(Continued)

(52) U.S. Cl.
CPC ..... *B65H 5/36* (2013.01); *B65H 3/0669* (2013.01); *B65H 5/062* (2013.01); *B65H 5/38* (2013.01);
(Continued)

(58) Field of Classification Search
CPC ..... B65H 2407/51; B65H 5/36; B65H 5/062; B65H 2403/40; B65H 2402/45; B65H 2402/441; G03G 21/1633
See application file for complete search history.

(56) References Cited

U.S. PATENT DOCUMENTS 9,751,706 B2 * 9/2017 Shimizu ..... B65H 3/44
2013/0050378 A1 2/2013 Okamoto

FOREIGN PATENT DOCUMENTS

JP 2006-184537 A 7/2006
JP 2006184537 A * 7/2006
(Continued)

OTHER PUBLICATIONS

Translation of International Preliminary Report on Patentability and Written Opinion dated Oct. 27, 2020 received in International Application No. PCT/JP2018/016964, together with an English-language translation.
(Continued)

*Primary Examiner* — Jeremy R Severson
(74) *Attorney, Agent, or Firm* — Scully, Scott, Murphy & Pressser, PC

(57) ABSTRACT

A sheet conveying device includes: a housing in which a conveying path of a sheet is formed; a roller configured to convey the sheet by rotation; a motor arranged inside of the housing; a drive transmitter configured to transmit a drive force of the motor to the roller; a movement member including a guide part configured to guide the sheet and at least a part of the drive transmitter, the movement member being movable to a first position closing the inside of the housing with respect to an outside of the housing and a second position different from the first position; and a dust proofing part attached to a position filling a gap between the movement member located in the first position and the housing.

12 Claims, 12 Drawing Sheets

(51) Int. Cl.
*B65H 5/06* (2006.01)
*B65H 5/38* (2006.01)

(52) U.S. Cl.
CPC .... *B65H 2402/441* (2013.01); *B65H 2402/45* (2013.01); *B65H 2403/40* (2013.01); *B65H 2404/16* (2013.01); *B65H 2407/21* (2013.01); *B65H 2407/51* (2013.01)

(56) References Cited

FOREIGN PATENT DOCUMENTS

| | | | | |
|---|---|---|---|---|
| JP | 2008-105807 | A | | 5/2008 |
| JP | 2008105807 | A | * | 5/2008 |
| JP | 2011-32023 | A | | 2/2011 |
| JP | 2013-43775 | A | | 3/2013 |
| JP | 2017-30876 | A | | 2/2017 |

OTHER PUBLICATIONS

International Search Report dated Jul. 3, 2018 received in International Application No. PCT/JP2018/016964, together with an English-language translation.

* cited by examiner

SHEET CONVEYING DEVICE AND IMAGE RECORDING APPARATUS

CROSS-REFERENCE TO RELATED APPLICATION

This is a continuation application of International Application No. PCT/JP2018/016964 filed on Apr. 26, 2018. The entire subject-matter of the earlier application is incorporated herein by reference.

TECHNICAL FIELD

The present disclosure relates to a sheet conveying device configured to convey a sheet, and an image recording apparatus including the sheet conveying device and configured to record an image on a sheet conveyed by the sheet conveying device.

BACKGROUND

There has been known a sheet conveying device configured to convey a sheet. As an apparatus including the sheet conveying device, it has been known an image recording apparatus configured to form an image on a sheet, for example.

There is an image recording apparatus having a cover that can be opened and closed and detachably mounted with respect to a housing. When the cover is opened or detached with respect to the housing, an inside of the housing is exposed. Therefore, in a case where the sheet is jammed inside of the housing, when the cover is opened or detached with respect to the housing, the inside of the housing is exposed, so that the jammed sheet can be taken out. A related-art image recording apparatus has a cover that can be detached from the housing so as to take out a sheet jammed inside.

SUMMARY

There is an image recording apparatus in which components such as a gear are arranged in the vicinity of the cover. For example, according to the related-art image recording apparatus, a roller is attached to the cover. That is, according to the related-art image recording apparatus, a gear and the like for rotating the roller is arranged in the vicinity of the cover.

In this case, following problems may occur. That is, in a case where the image recording apparatus is equipped in a dusty environment (for example, a sandy dust outdoors or a stall facing such outdoors and having no partitions such as a window and a door or having few such partitions), even if the cover is closed with respect to the housing or the cover is mounted with respect to the housing, the sandy dust and the like may be introduced into the housing through a gap between the cover and the housing. The sandy dust and the like introduced into the housing may be attached to the gear and the like arranged in the vicinity of the cover, thereby hindering drive of the gear and the like. As a result, rotation of the roller is hindered, so that the sheet may not be conveyed.

Illustrative aspects of the present disclosure provide a sheet conveying device capable of suppressing sandy dust and the like from being introduced into the device.

According to one illustrative aspect of the present disclosure, a sheet conveying device includes: a housing in which a conveying path of a sheet is formed; a roller configured to convey the sheet by rotation; a motor arranged inside of the housing; a drive transmission unit configured to transmit a drive force of the motor to the roller; a movement member including a guide part configured to guide the sheet and at least a part of the drive transmission unit, the movement member being movable to a first position closing the inside of the housing with respect to an outside of the housing and a second position different from the first position; and a dust proofing part attached to a position filling a gap between the movement member located in the first position and the housing.

Since the dust proofing part is attached to the position in which the gap between the movement member located in the first position and the housing is filled, the introduction of the sandy dust and the like from the gap into the housing can be reduced. Thereby, it is possible to reduce attachment of the sandy dust and the like to the drive transmission unit. As a result, it is possible to reduce a possibility that the sheet cannot be conveyed due to poor rotation of the roller.

According to the present disclosure, it is possible to suppress the sandy dust and the like from being introduced into the device.

DETAILED DESCRIPTION

Figure 1:
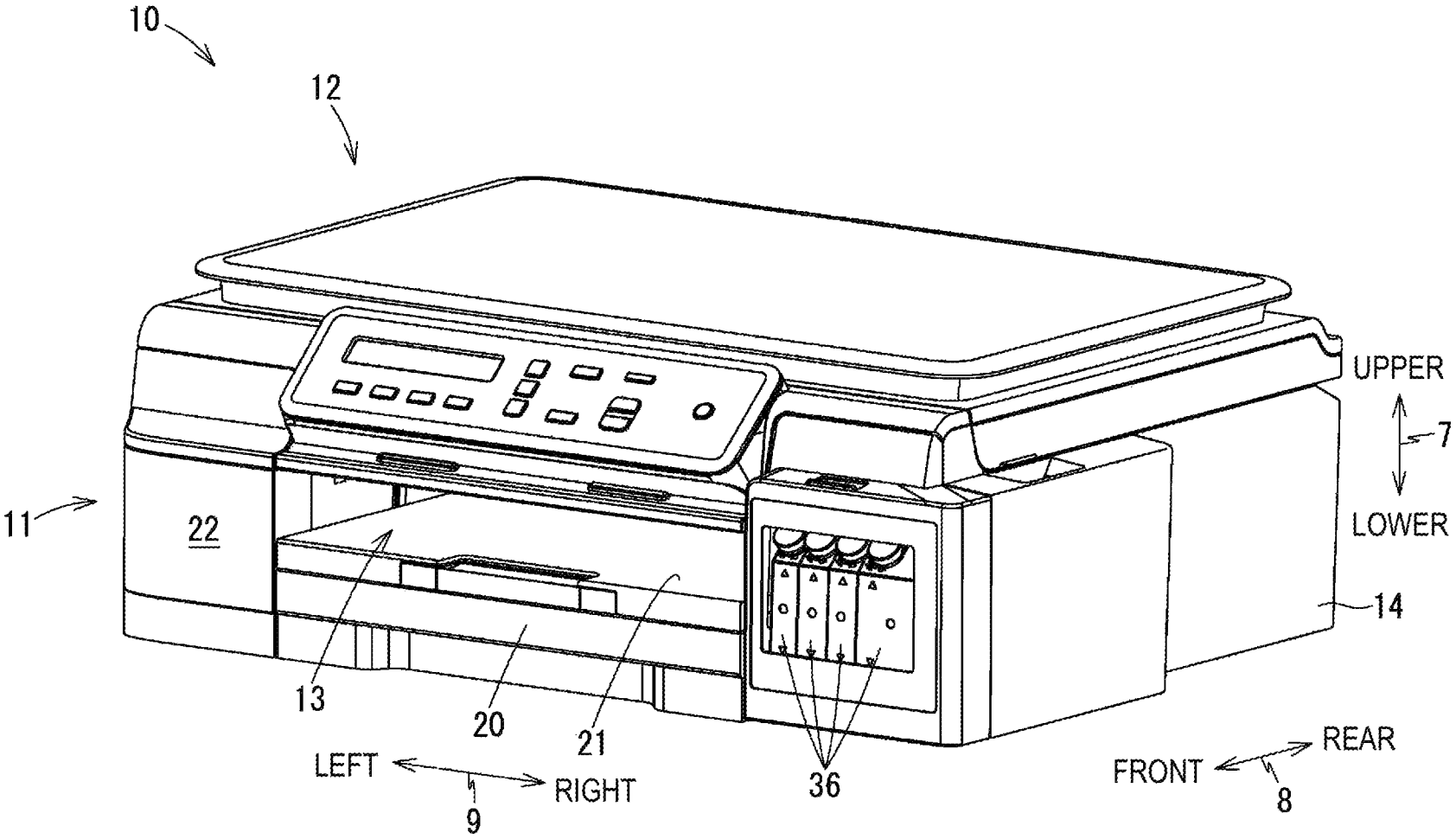
FIG. 1 is a perspective view depicting an outer appearance of a multifunction peripheral 10, as seen from right front.

Hereinbelow, illustrative embodiments of the present disclosure will be described. The illustrative embodiments that will be described later are just examples of the present disclosure, and can be changed as appropriate without departing from the gist of the present disclosure. Also, in descriptions below, a vertical direction 7 is defined based on a state (a state shown in FIG. 1) where a multifunction peripheral 10 is equipped so as to be usable, a front and rear direction 8 is defined based on a front surface 22 on which an opening 13 is provided, and a right and left direction 9 is defined based on a multifunction peripheral 10 as seen from front. The vertical direction 7, the front and rear direction 8, and the right and left direction 9 are orthogonal to each other.

<Overall Structure of Multifunction Peripheral 10>

As shown in FIG. 1, the multifunction peripheral 10 (an example of the image recording apparatus) has a substantially thin cuboid shape.

The multifunction peripheral 10 has a scanner unit 12 provided at an upper part. The scanner unit 12 is configured to read an image recorded on a document such as a sheet by an image sensor, thereby acquiring image data. The scanner unit 12 is a so-called flatbed scanner. Since the flatbed scanner is known, the detailed description of the scanner unit 12 is omitted herein.

The multifunction peripheral 10 has a printer unit 11 provided at a lower part. The printer unit 11 is configured to record an image on a sheet 15 (an example of the sheet; refer to FIG. 2), based on the image data and the like.

Figure 2:
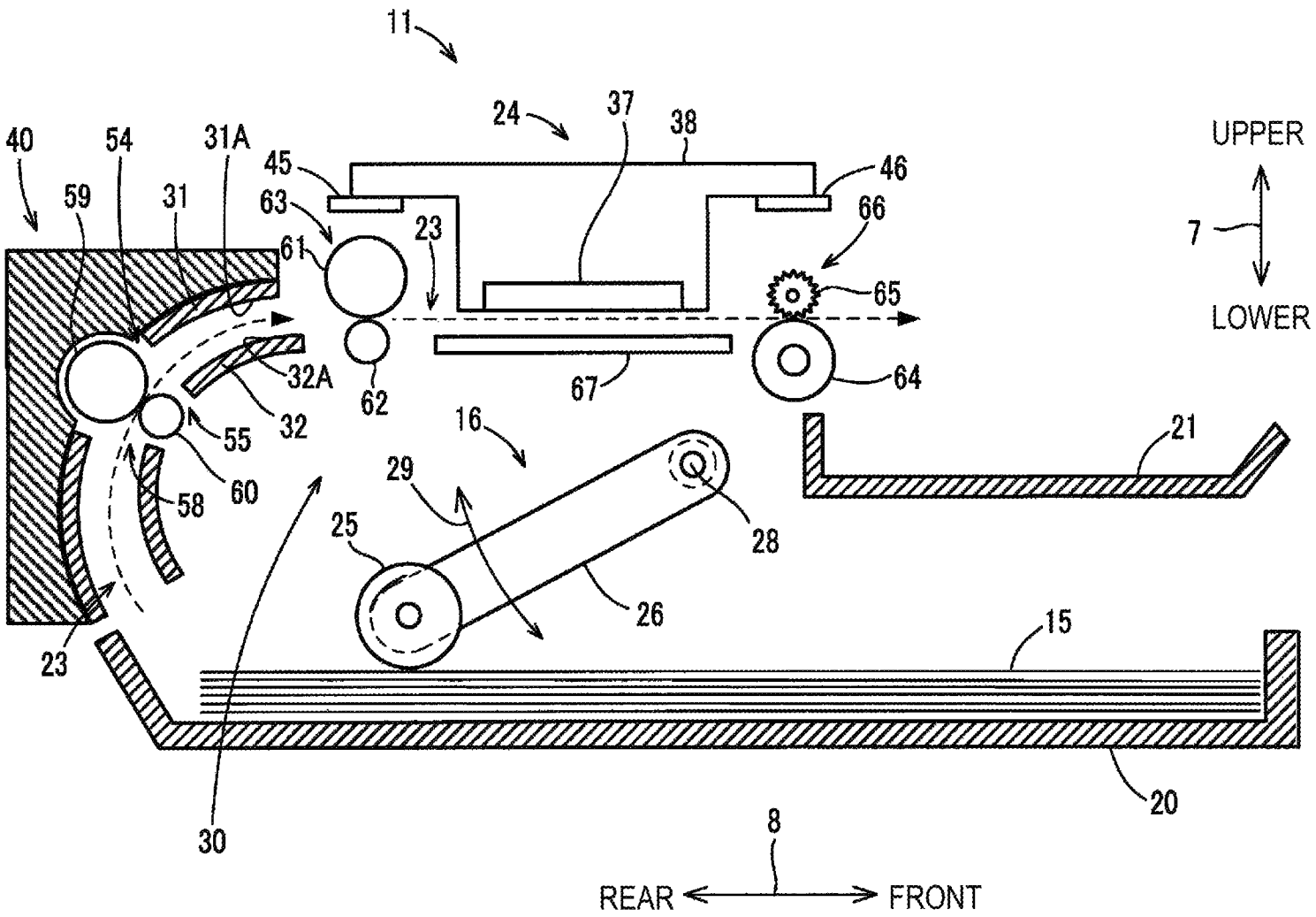
FIG. 2 is a longitudinal sectional view depicting pictorially an internal structure of a printer unit 11.

As shown in FIG. 2, the printer unit 11 includes a sheet conveying device, and a recording unit 24. The sheet conveying device includes a printer housing 14 (an example of the housing; refer to FIG. 1), a cover 40 (an example of the movement member), a conveying motor 89 (an example of the motor; refer to FIGS. 6 and 7), a drive transmission unit 90 (refer to FIGS. 5 to 7), a feeder unit 16, a first conveyor roller pair 58, a second conveyor roller pair 63, a discharging roller pair 66, and a dust proofing part 70 (refer to FIGS. 4 to 7). Note that, each unit of the sheet conveying device and the recording unit 24 will be described in detail later.

<Printer Housing 14>

As shown in FIG. 1, the printer housing 14 configures an outer shape of the printer unit 11. The printer housing 14 has a substantially cuboid box shape. The printer housing 14 has an internal space 30 (refer to FIG. 2). As shown in FIG. 2, a conveying path 23 is formed in the internal space 30. Also, in the internal space 30, the conveying motor 89 (refer to FIGS. 6 and 7), the drive transmission unit 90 (refer to FIGS. 5 to 7), the feeder unit 16, the first conveyor roller pair 58, the second conveyor roller pair 63, the discharging roller pair 66, the recording unit 24 and the like are arranged.

As shown in FIG. 1, an opening 13 is formed on a front surface 22 of the printer housing 14. A feeding tray 20 and a discharging tray 21 can be inserted and pulled out in the front and rear direction 8 with respect to the printer housing 14, through the opening 13. In the feeding tray 20, the sheet 15 of a desired size is supported. On the discharging tray 21, the sheet 15 having an image recorded thereon by the recording unit 24 and discharged from the internal space 30 is supported. Note that, FIG. 1 depicts a state where the feeding tray 20 and the discharging tray 21 are mounted to the printer housing 14.

<Feeder Unit 16>

As shown in FIG. 2, the feeder unit 16 is arranged below the recording unit 24. The feeder unit 16 includes a feeding roller 25, a feeding arm 26, and a shaft 28. The feeding roller 25 is rotatably supported at a tip end portion of the feeding arm 26. The feeding arm 26 is configured to rotate in a direction of an arrow 29 about the shaft 28 provided at a base end portion thereof. Thereby, the feeding roller 25 can be contacted and separated with respect to the feeding tray 20 or the sheet 15 supported in the feeding tray 20.

The feeding roller 25 is rotated as a drive force of the conveying motor 89 (refer to FIGS. 6 and 7) is transmitted thereto. The drive force of the conveying motor 89 is transmitted to the shaft 28 via the drive transmission unit 90 (refer to FIGS. 5 to 7), which will be described later. The shaft 28 and the feeding roller 25 are coupled to each other by an endless belt, a gear train and the like. Thereby, the drive force transmitted to the shaft 28 is transmitted to the feeding roller 25. The feeding roller 25 rotates, so that the top sheet 15, which is in contact with the feeding roller 25, of the sheets 15 supported in the feeding tray 20 is fed to the conveying path 23.

<Conveying Path 23>

As shown in FIG. 2, the conveying path 23 is a path that starts from a rear end portion of the feeding tray 20, makes a U-turn while extending upward from below, and then extends forward and passes under the recording unit 24 to reach the discharging tray 21. The conveying path 23 is a space defined by a guide member 32 and a guide part 31 of the cover 40 facing each other with a predetermined gap, the second conveyor roller pair 63, the recording unit 24 and a platen 67 facing each other with a predetermined gap, and the discharging roller pair 66. The sheet 15 is conveyed in a conveying direction, which is a direction shown with a broken arrow in FIG. 2, along the conveying path 23.

The guide part 31 has a curved surface 31A curved so as to face forward and be concave rearward. The guide member 32 has a curved surface 32A curved so as to face rearward and be convex rearward. The two curved surfaces 31A and 32A face each other, so that the conveying path 23 making a U-turn while extending upward from below is formed. The sheet 15 is guided along the curved surfaces 31A and 32A.

<Roller Pairs 58, 63 and 66>

As shown in FIG. 2, the first conveyor roller pair 58 is arranged on the conveying path 23. The first conveyor roller pair 58 consists of a conveyor roller 59 (an example of the roller) and a pinch roller 60. The conveyor roller 59 is rotatably supported by the cover 40. A part of the conveyor roller 59 protrudes toward the conveying path 23 beyond the curved surface 31A, through an opening 54 formed in the guide part 31 of the cover 40. Thereby, the conveyor roller 59 defines the conveying path 23. The pinch roller 60 is rotatably supported by the guide member 32. A part of the pinch roller 60 protrudes toward the conveying path 23 beyond the curved surface 32A, through an opening 55 formed in the guide member 32. Thereby, the pinch roller 60 defines the conveying path 23. The pinch roller 60 is pressed against the conveyor roller 59 by an elastic member (not shown) such as a spring. Thereby, the first conveyor roller pair 58 can hold the sheet 15.

On the conveying path 23, the second conveyor roller pair 63 is arranged downstream of the first conveyor roller pair 58 with respect to the conveying direction. The second conveyor roller pair 63 consists of a conveyor roller 61 and a pinch roller 62. The pinch roller 62 is pressed against the conveyor roller 61 by an elastic member (not shown) such as a spring. Thereby, the second conveyor roller pair 63 can hold the sheet 15.

On the conveying path 23, the discharging roller pair 66 is arranged downstream of the second conveyor roller pair 63 with respect to the conveying direction. The discharging roller pair 66 consists of a discharging roller 64 and a spur 65. The spur 65 is pressed against the discharging roller 64 by an elastic member (not shown) such as a spring. Thereby, the discharging roller pair 66 can hold the sheet 15.

The first conveyor roller pair 58, the second conveyor roller pair 63, and the discharging roller pair 66 are configured to convey the sheet 15 that is fed to the conveying path 23 by the feeding roller 25. The conveyor roller 59, the conveyor roller 61, and the discharging roller 64 are driven as the drive force of the conveying motor 89 (refer to FIGS. 6 and 7) is transmitted thereto. The conveyor roller 59 to which the drive force is transmitted conveys the sheet 15 in the conveying direction while holding the sheet 15 between the conveyor roller 59 and the pinch roller 60. The conveyor roller 61 to which the drive force is transmitted conveys the sheet 15 in the conveying direction while holding the sheet 15 between the conveyor roller 61 and the pinch roller 62. The discharging roller 64 to which the drive force is transmitted conveys the sheet 15 in the conveying direction while holding the sheet 15 between the discharging roller 64 and the spur 65.

<Recording Unit 24>

As shown in FIG. 2, the recording unit 24 is arranged between the second conveyor roller pair 63 and the discharging roller pair 66 on the conveying path 23. The recording unit 24 is configured to record an image on the sheet 15 by an inkjet method, based on image data read from a document by the scanner unit 12, for example. The recording unit 24 includes a recording head 37 configured to eject ink droplets by the inkjet method, and a carriage 38 on which the recording head 37 is mounted. The carriage 38 is supported by guide rails 45 and 46 so as to be movable along the right and left direction 9 orthogonal to the conveying direction of the sheet 15. The guide rails 45 and 46 are supported to the printer housing 14. The carriage 38 is moved as a drive force of a carriage driving motor (not shown) is transmitted thereto.

The recording head 37 is arranged at a lower part of the carriage 38. A lower surface of the recording head 37 is formed with a plurality of nozzles (not shown). The nozzles are exposed on a lower surface of the carriage 38. The ink droplets are ejected from the nozzles toward the lower platen 67. The platen 67 is arranged below the recording head 37 to face the recording head 37. The platen 67 has a substantially flat plate shape, and can support the sheet 15 on an upper surface thereof.

As shown in FIG. 1, ink tanks 36 of respective colors (for example, black, yellow, cyan and magenta) are arranged on a right front part of the printer unit 11. The inks of respective colors are supplied from the ink tanks 36 to the recording head 37 shown in FIG. 2. While the carriage 38 is moving in the right and left direction 9, the inks of respective colors are selectively ejected from the respective nozzles, as fine ink droplets. Thereby, an image is recorded on the sheet 15 that is conveyed on the platen 67.

Note that, the method by which the recording unit 24 records an image on the sheet 15 is not limited to the inkjet method, and may be an electrophotographic method, for example.

<Cover 40>

Figure 3:
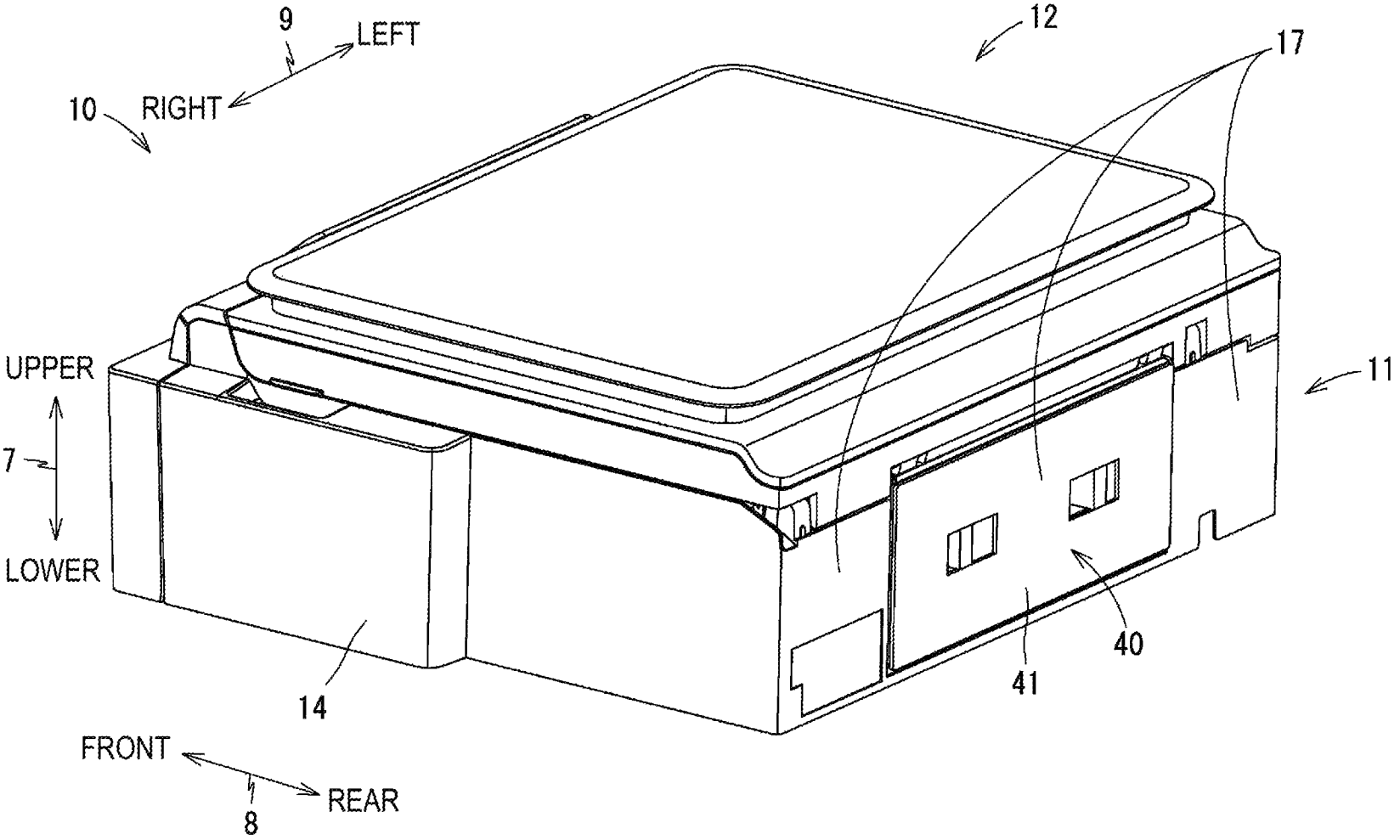
FIG. 3 is a perspective view depicting the outer appearance of the multifunction peripheral 10 in a state where a cover 40 is located in a closed position, as seen from right rear.
Figure 4:
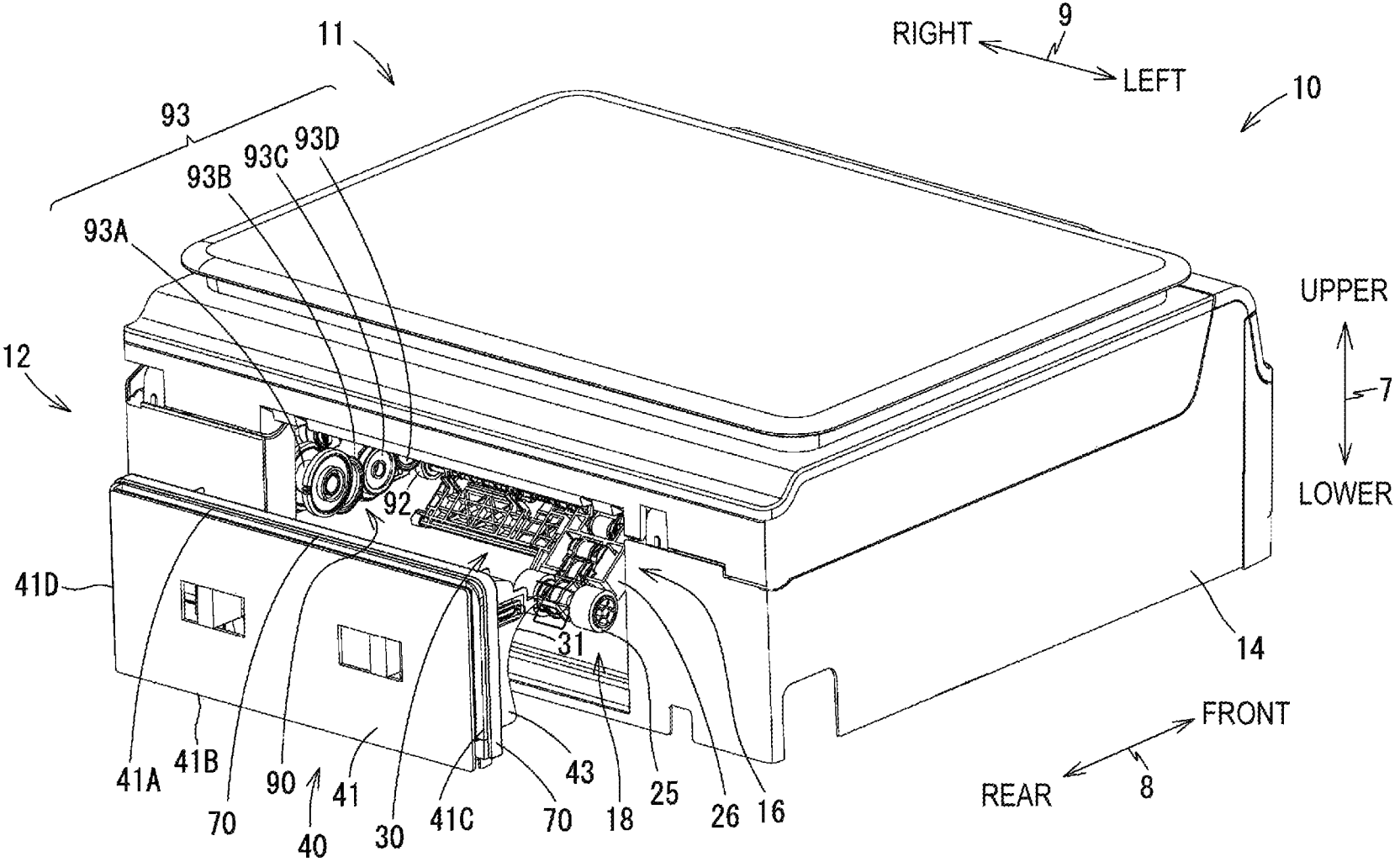
FIG. 4 is a perspective view depicting the outer appearance of the multifunction peripheral 10 in a state where the cover 40 is located in an exposed position, as seen from left rear.

As shown in FIG. 3, the cover 40 is attached to a rear surface 17 of the printer housing 14. The cover 40 can be attached and detached with respect to the printer housing 14, through an opening 18 (refer to FIG. 4) formed in the rear surface 17. The cover 40 is attached to the printer housing 14 by a well-known means such as fitting. FIGS. 2 and 3 depict a state where the cover 40 is mounted to the printer housing 14. FIG. 4 depicts a state where the cover 40 is detached from the printer housing 14. In descriptions of the configuration of the cover 40, the vertical direction 7, the front and rear direction 8, and the right and left direction 9 are defined based on the cover 40 in a posture shown in FIGS. 3 and 4.

Figure 5:
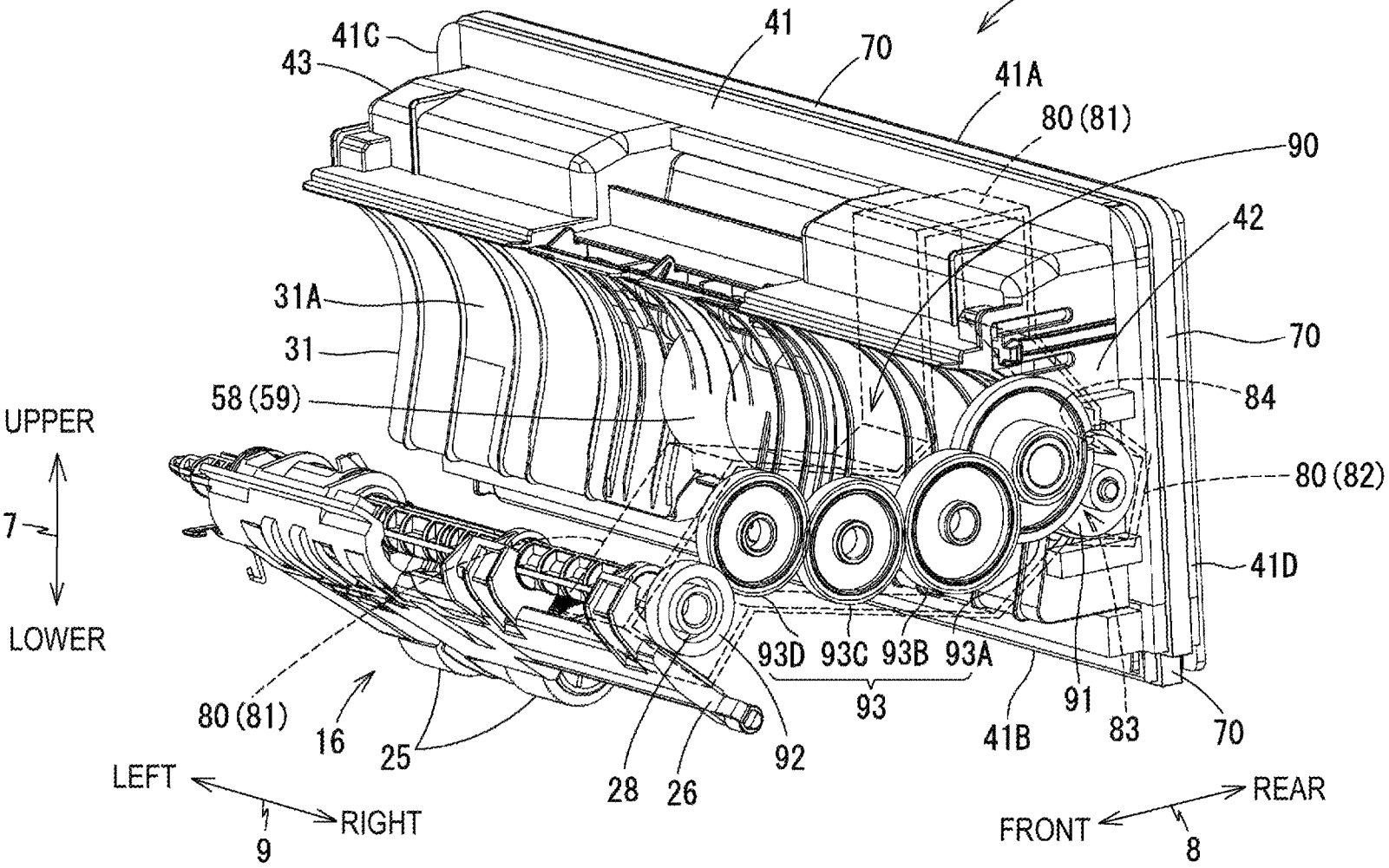
FIG. 5 is a perspective view of the cover 40 located in the closed position, a drive transmission unit 90 and a feeder unit 16.

As shown in FIG. 5, the cover 40 has an outer wall 41, a right wall 42, a left wall 43, and the guide part 31.

The outer wall 41 is a wall extending substantially in the vertical direction 7 and the right and left direction 9. As shown in FIG. 3, a rear surface of the outer wall 41 configures a part of the rear surface 17 of the printer housing 14 in a state where the cover 40 is mounted to the printer housing 14.

As shown in FIG. 5, the right wall 42 extends forward from a right end portion of a front surface of the outer wall 41. The left wall 43 extends forward from a left end portion of the front surface of the outer wall 41.

The guide part 31 is supported from a rear side of the curved surface 31A by the outer wall 41. Also, the guide part 31 has a right end portion supported by the right wall 42, and a left end portion supported by the left wall 43. The guide part 31 is coupled to at least one of the outer wall 41, the right wall 42, and the left wall 43 by a well-known means such as fitting and screw fastening. Note that, the guide part 31 may also be integrated with at least one of the outer wall 41, the right wall 42, and the left wall 43.

As shown in FIG. 4, in the state where the cover 40 is detached from the printer housing 14, the internal space 30 of the printer housing 14 is exposed to the outside of the printer housing 14. The position of the cover 40 at this time is an exposed position (an example of the second position).

As shown in FIG. 3, in the state where the cover 40 is mounted to the printer housing 14, the internal space 30 of the printer housing 14 is closed with respect to the outside of the printer housing 14. Also, as shown in FIG. 2, in the state where the cover 40 is mounted to the printer housing 14, the guide part 31 faces the guide member 32. Thereby, the guide part 31 defines the conveying path 23. The position of the cover 40 at this time is a closed position (an example of the first position). Thereby, the cover 40 can move to the exposed position and the closed position.

Note that, the cover 40 can also move to the exposed position and the closed position by a manner other than the attachment and detachment. For example, the cover 40 may be rotatably supported by the printer housing 14 via a shaft formed at lower end portions of the right wall 42 and the left wall 43, and may move to the exposed position and the closed position by rotation. Also, for example, the cover 40 may be supported to be slidable along the front and rear direction 8 by the printer housing 14, and may move from the closed position to the exposed position by rearward sliding and move from the exposed position to the closed position by forward sliding.

<Conveying Motor 89 and Drive Transmission Unit 90>

Figure 6:
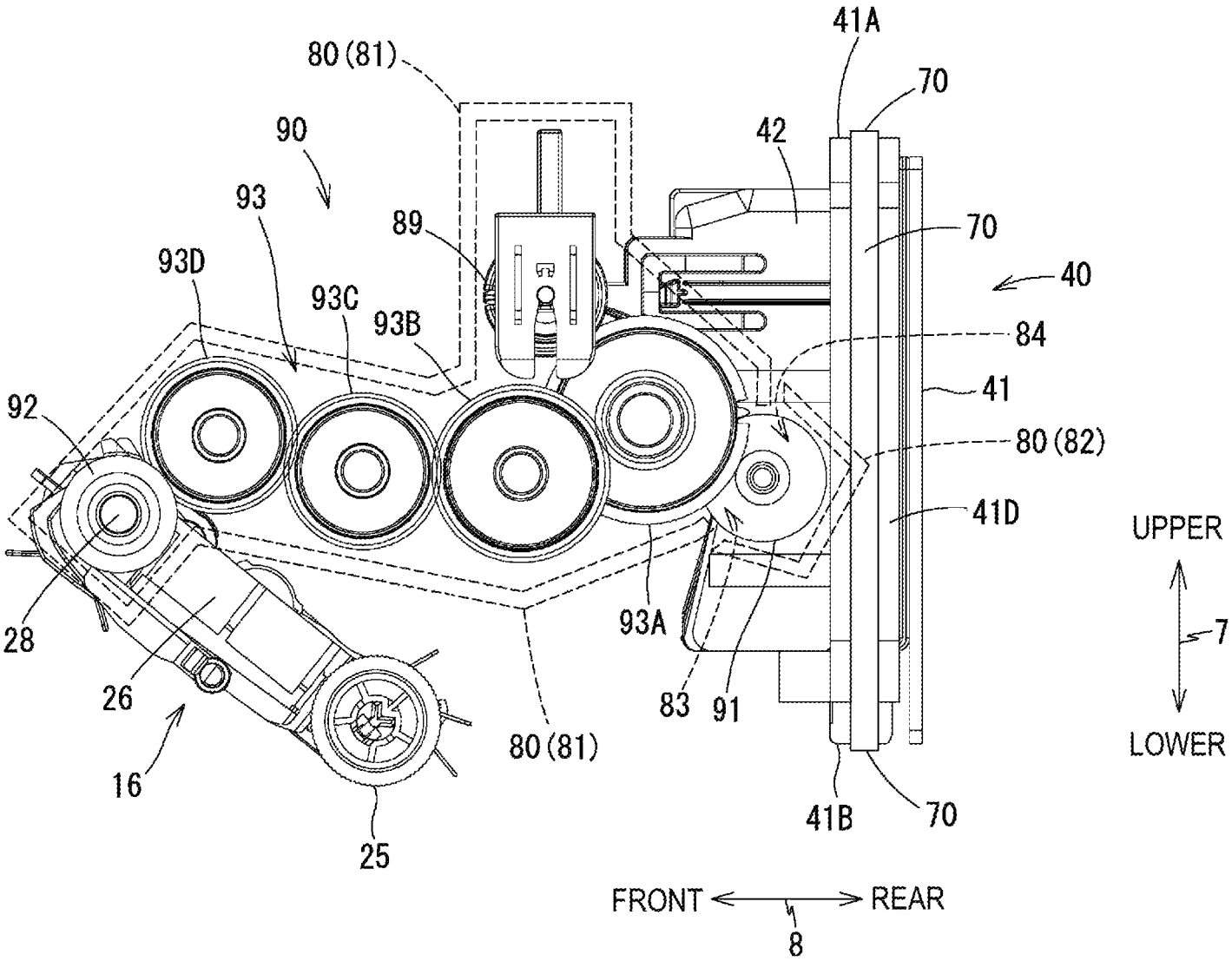
FIG. 6 is a left side view of the cover 40 located in the closed position, the drive transmission unit 90 and the feeder unit 16.

The conveying motor 89 is arranged in the internal space 30 of the printer housing 14. In the present illustrative embodiment, as shown in FIG. 6, the conveying motor 89 is arranged in front of the cover 40 located in the closed position. The conveying motor 89 may also be arranged in a position other than the position shown in FIG. 6.

The drive transmission unit 90 is to transmit the drive force of the conveying motor 89 to the feeding roller 25, the conveyor roller 59, the conveyor roller 61, and the discharging roller 64.

As shown in FIGS. 5 and 6, the drive transmission unit 90 includes a first gear 91 (an example of the gear), a second gear 92, and a gear train 93.

The first gear 91 is rotatably supported by the right wall 42 of the cover 40. The first gear 91 is configured to rotate coaxially and integrally with the conveyor roller 59.

The second gear 92 is rotatably supported by the printer housing 14. The second gear 92 is configured to rotate coaxially and integrally with the shaft 28 of the feeder unit 16.

Figure 7:
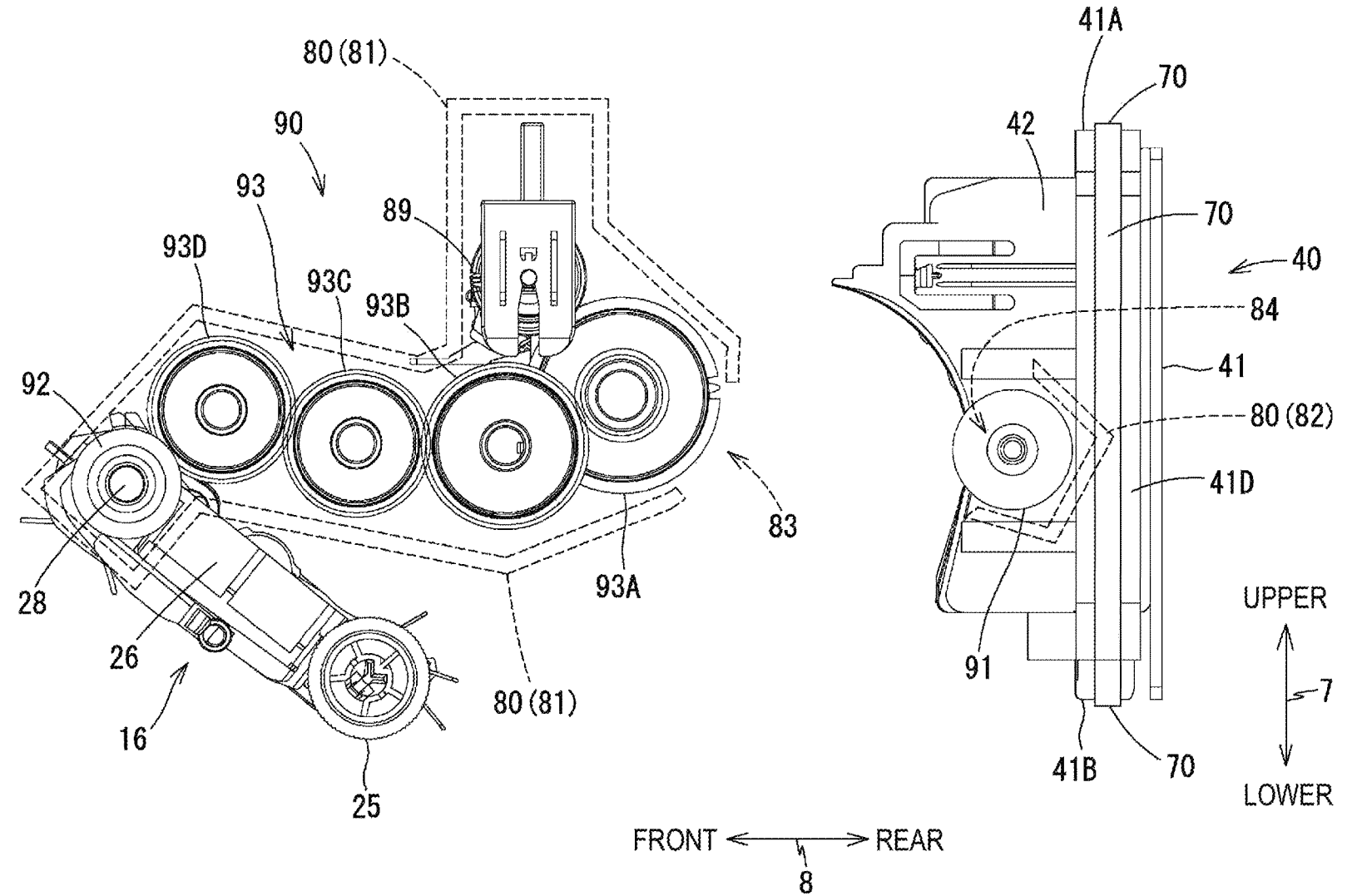
FIG. 7 is a left side view of the cover 40 located in the exposed position, the drive transmission unit 90 and the feeder unit 16.

The gear train 93 is configured by four gears 93A, 93B, 93C and 93D. The gear 93A is in mesh with the conveying motor 89. That is, the gear train 93 is applied with the drive force from the conveying motor 89. Also, the gear 93A can engage with the first gear 91. Specifically, as shown in FIG. 6, when the cover 40 is located in the closed position, the first gear 91 engages with the gear 93A. On the other hand, as shown in FIG. 7, when the cover 40 is located in the exposed position, the first gear 91 separates from the gear 93A. The gear 93D is in mesh with the second gear 92.

By the above, the drive force of the conveying motor 89 is transmitted to the conveyor roller 59 via the gear train 93 and the first gear 91. Also, the drive force of the conveying motor 89 is transmitted to the feeding roller 25 via the gear train 93 and the second gear 92.

Also, although not shown, the drive transmission unit 90 includes a gear train configured to transmit the drive force of the conveying motor 89 to the conveyor roller 61 and the discharging roller 64.

Note than, in the present illustrative embodiment, the gear train 93 is configured by the four gears 93A, 93B, 93C and 93D but may also be configured by gears other than the four gears. However, a condition is that both the feeding roller 25 and the conveyor roller 59 rotate so as to convey the sheet 15 in the conveying direction. Specifically, in FIG. 2, when the feeding roller 25 rotates clockwise (a direction in which the sheet 15 is fed to the conveying path 23), the conveyor roller 59 is required to rotate counterclockwise (a direction in which the sheet 15 is conveyed to the conveying direction).

Also, in the present illustrative embodiment, the drive transmission unit 90 transmits the drive force of the conveying motor 89 to each roller by the gear train. However, the means for transmitting the drive force is not limited to the gear train. For example, the drive force of the conveying motor 89 may also be transmitted to each roller by a belt and the like. Also, the drive transmission unit 90 may be configured to switch transmission of the drive force from the conveying motor 89 to each roller by a well-known switching mechanism.

<Covering Part 80>

As shown in FIGS. 5 to 7, a covering part 80 is arranged in the internal space 30 of the printer housing 14. The covering part 80 is a hollow member. In the covering part 80, the drive transmission unit 90 is arranged. That is, the covering part 80 covers the drive transmission unit 90. Note that, in FIGS. 5 to 7, the covering part 80 is shown with the broken line so that the drive transmission unit 90 arranged in the covering part 80 is not concealed. Also, in FIGS. 4 and 8, the covering part 80 is not shown.

In the present illustrative embodiment, the covering part 80 has a first covering part 81 and a second covering part 82.

In the first covering part 81, the conveying motor 89, the second gear 92, and the gear train 93 are arranged. The first covering part 81 has an opening 83. A part of the gear 93A is exposed through the opening 83.

In the second covering part 82, the first gear 91 is arranged. The second covering part 82 has an opening 84. A part of the first gear 91 is exposed through the opening 84.

In the state where the cover 40 is located in the closed position, the part of the gear 93A exposed through the opening 83 and the part of the first gear 91 exposed through the opening 84 engage with each other.

By the above, the first covering part 81 covers a part of the gear train 93 except an engaged part engaged with the first gear 91. Also, the second covering part 82 covers a part of the first gear 91 except an engaged part engaged with the gear train 93.

In the present illustrative embodiment, the first gear 91 and the gear 93A of the drive transmission unit 90 engage with each other when the cover 40 is located in the closed position, and separate from each other when the cover 40 is located in the exposed position. In the present illustrative embodiment, the covering part 80 includes the first covering part 81 having the opening 83 and the second covering part 82 having the opening 84 so as to cope with the connection and separation between the first gear 91 and the gear 93A.

However, for example, in a case where the conveyor roller 59 is supported by the printer housing 14, not the cover 40, the first gear 91 and the gear 93A are in mesh with each other all the time. In this case, the covering part 80 may be configured by one piece, without being divided into a plurality of pieces (for example, the first covering part 81 and the second covering part 82). In the covering part 80 of one piece, the conveying motor 89, the first gear 91, the second gear 92, and the gear train 93 may be arranged.

<Dust Proofing Part 70>

The dust proofing part 70 is to prevent sandy dust and the like from being introduced from the outside of the printer housing 14 into the internal space 30. The dust proofing part 70 is formed of a porous material such as foamed polyurethane.

The dust proofing part 70 is attached to a position in which a gap between the cover 40 located in the closed position and the printer housing 14 is filled.

For example, as shown in FIGS. 4 to 7, the dust proofing part 70 is attached along an edge of the outer wall 41 of the cover 40. Specifically, the dust proofing part 70 is attached along an upper surface 41A, a lower surface 41B, a left side surface 41C, and a right side surface 41D of the outer wall 41.

Figure 8:
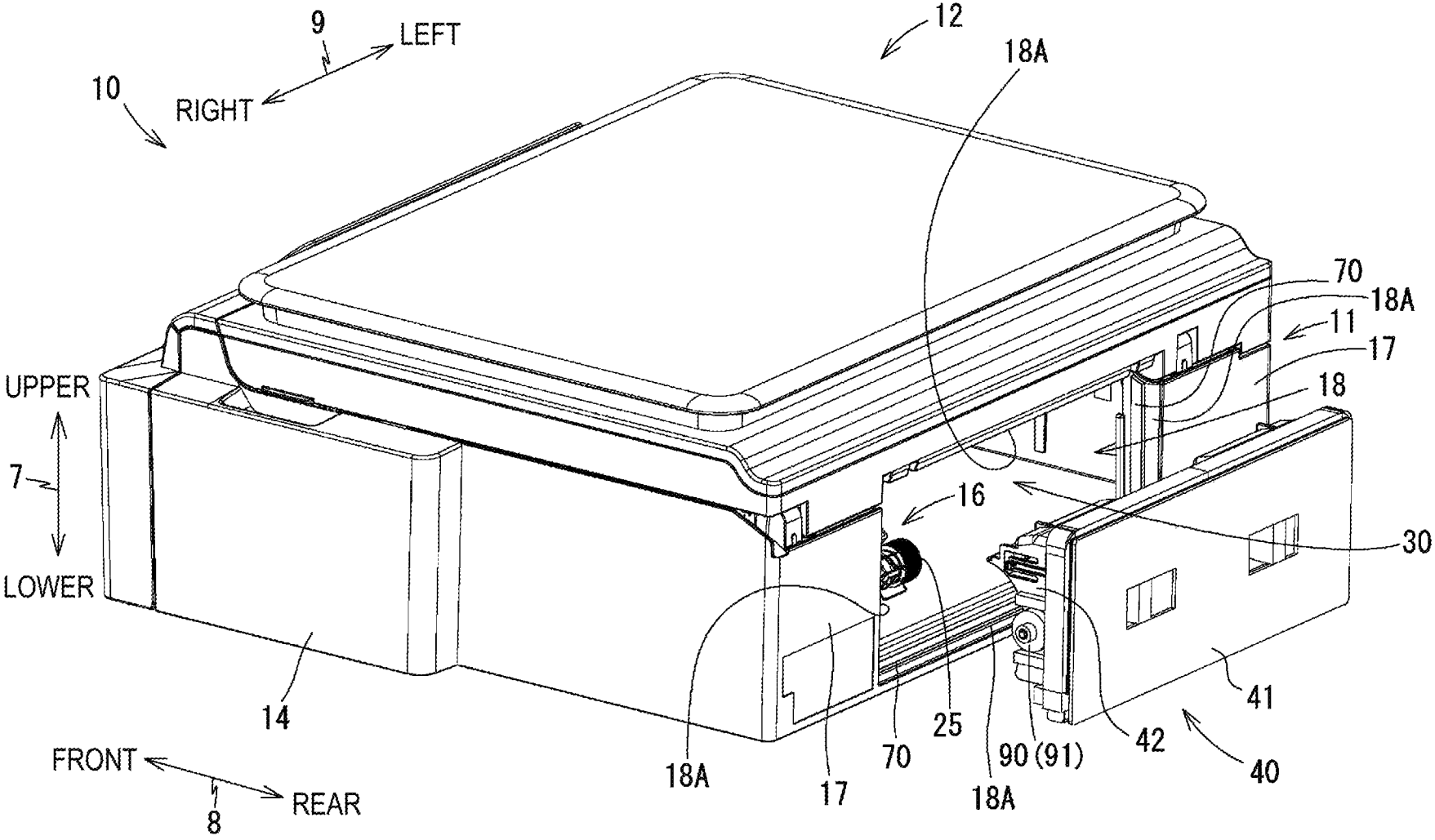
FIG. 8 is a perspective view depicting the outer appearance of the multifunction peripheral 10 in a state where the cover 40 is located in the exposed position, in a modified illustrative embodiment.

The dust proofing part 70 may also be attached to the printer housing 14. In this case, for example, as shown in FIG. 8, the dust proofing part 70 is attached to the printer housing 14 along an edge surface 18A defining the opening 18.

<Advantages>

Since the dust proofing part 70 is attached to the position in which the gap between the cover 40 located in the closed position and the printer housing 14 is filled, the introduction of the sandy dust and the like from the gap into the printer housing 14 can be reduced. Thereby, it is possible to reduce attachment of the sandy dust and the like to the drive transmission unit 90. As a result, it is possible to reduce a possibility that the sheet 15 cannot be conveyed due to poor rotations of the feeding roller 25, the conveyor roller 59, the conveyor roller 61, and the discharging roller 64.

If the dust proofing part 70 is attached to the printer housing 14, the cover 40 may be caught at the dust proofing part 70 while the cover 40 moves between the exposed position and the closed position. In the present illustrative embodiment, since the dust proofing part 70 is attached to the cover 40, it is possible to reduce occurrence of the above-described catching.

Also, in the configuration where the conveyor roller 59 is attached to the cover 40, like the present configuration, when the sheet 15 is involved on the conveyor roller 59, the sheet 15 can be taken out more easily by moving the cover 40 to the exposed position, as compared to a configuration where the conveyor roller 59 is attached to the printer housing 14.

Also, when the cover 40 is located in the exposed position, the sandy dust and the like are introduced into the printer housing 14. However, it is possible to reduce the attachment of the sandy dust and the like to the gear train 93 by the first covering part 81.

Also, when the cover 40 is located in the exposed position, the sandy dust and the like are introduced into the printer housing 14. However, it is possible to reduce the attachment of the sandy dust and the like to the first gear 91 by the second covering part 82.

Also, when the cover 40 is located in the exposed position, the sandy dust and the like are introduced into the printer housing 14. However, it is possible to reduce the attachment of the sandy dust and the like to the drive transmission unit 90 by the covering part 80.

Also, the sandy dust and the like introduced into the dust proofing part 70 should pass through a plurality of fine pores formed in the dust proofing part 70 so as to enter from the outside to the inside of the printer housing 14. However, most of the sandy dust and the like are hindered from entering by the porous material walls among the plurality of fine pores, without passing through the plurality of fine pores. As a result, the sandy dust and the like can be suppressed from entering the inside of the printer housing 14.

Also, since the dust proofing part 70 is formed of the porous material, the air can move between the outside and the inside of the printer housing 14. Thereby, in the state where the cover 40 is located in the closed position, it is possible to suppress a situation where heat generated from the conveying motor 89 and the like arranged inside of the printer housing 14 is trapped inside of the printer housing 14 and the temperature inside of the printer housing 14 increases.

Modifications to Illustrative Embodiments

In the above illustrative embodiment, the cover 40 is an example of the movement member. However, the movement member is not limited to the cover 40.

For example, the movement member may be a second feeding tray 71, which is provided instead of the cover 40 or in addition to the cover 40. In the multifunction peripheral 10 shown in FIG. 9, the feeding tray 71 is attached to the printer housing 14, in addition to the cover 40. In the configuration shown in FIG. 9, the movement member is the cover 40 and the feeding tray 71.

Figure 9:
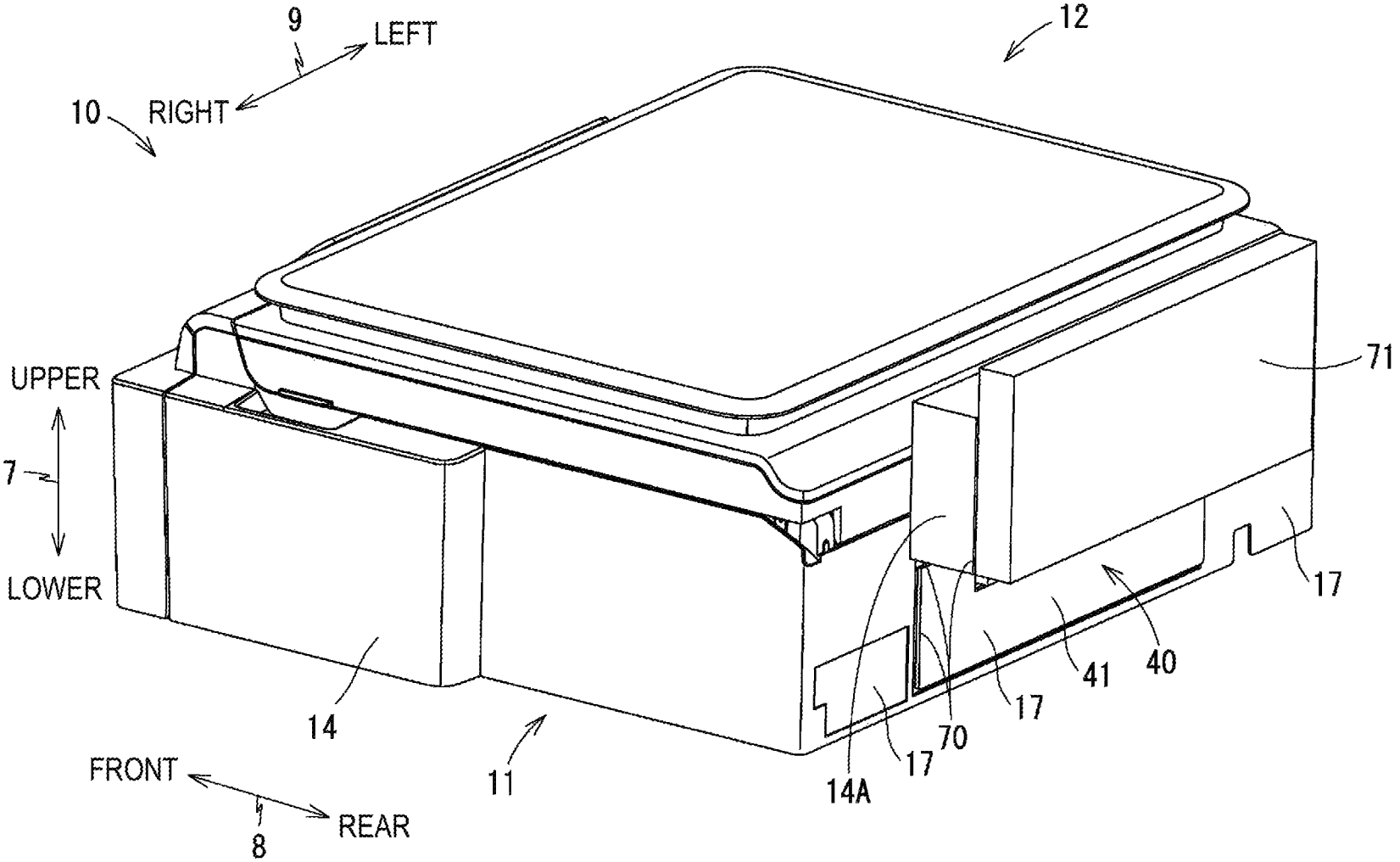
FIG. 9 is a perspective view depicting the outer appearance of the multifunction peripheral 10 in a state where a feeding tray 71 is located in a first position, as seen from right rear.
Figure 10:
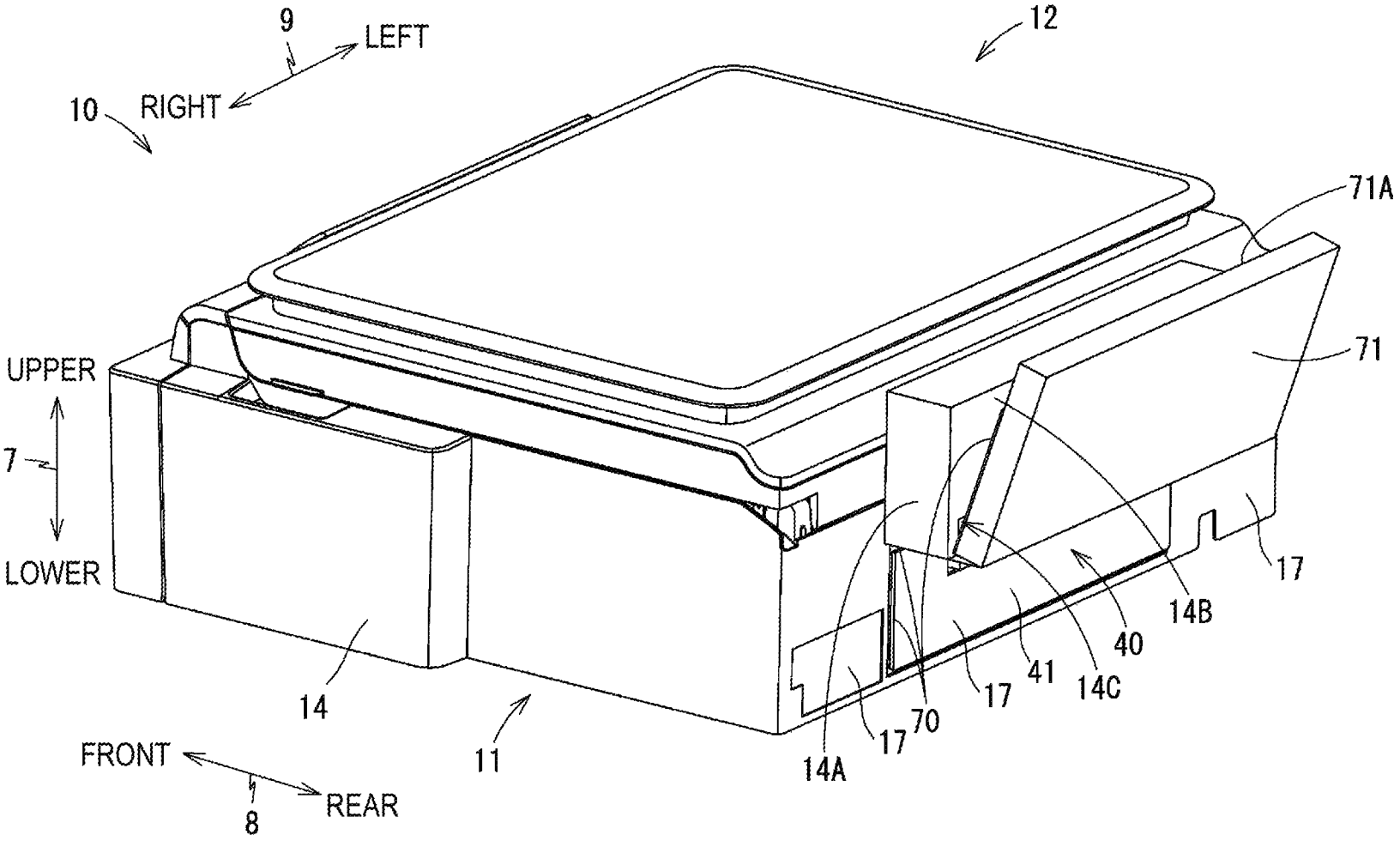
FIG. 10 is a perspective view depicting the outer appearance of the multifunction peripheral 10 in a state where the feeding tray 71 is located in a second position, as seen from right rear.

In the multifunction peripheral 10 shown in FIG. 9, the printer housing 14 is provided on the rear surface 17 with an attached part 14A to which the feeding tray 71 is attached. As shown in FIG. 10, a rear surface 14B of the attached part 14A is formed with an opening 14C through which the sheet 15 can pass from the outside of the printer housing 14 into the printer housing 14.

The feeding tray 71 can rotate to a first position shown in FIG. 9 and a second position shown in FIG. 10 with respect to the attached part 14A.

The feeding tray 71 located in the first position is erected with respect to the attached part 14A, and covers the opening 14C. Thereby, the inside of the printer housing 14 is closed with respect to the printer housing 14.

Figure 11:
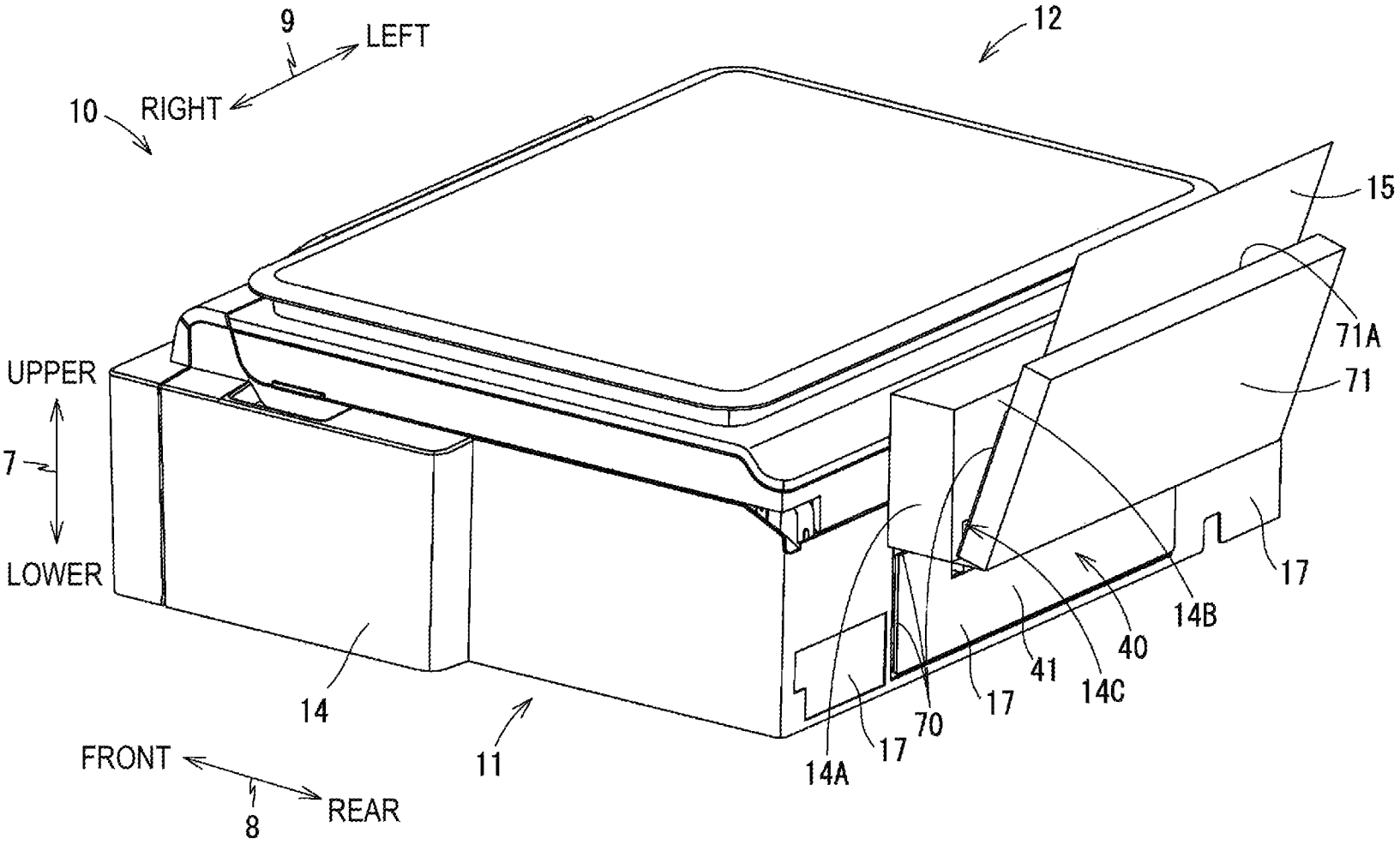
FIG. 11 is a perspective view depicting the outer appearance of the multifunction peripheral 10 in a state where a sheet 15 is supported in the feeding tray 71 located in the second position, as seen from right rear.

The feeding tray 71 located in the second position is tilted with respect to the attached part 14A. In this state, an upper surface 71A (an example of the guide part) of the feeding tray 71 can support the sheet 15, as shown in FIG. 11. The supported sheet 15 is guided along the upper surface 71A by a roller 72 (refer to FIG. 12) attached to the attached part 14A, and is fed to the conveying path 23 inside of the housing 14 through the opening 14C.

Figure 12:
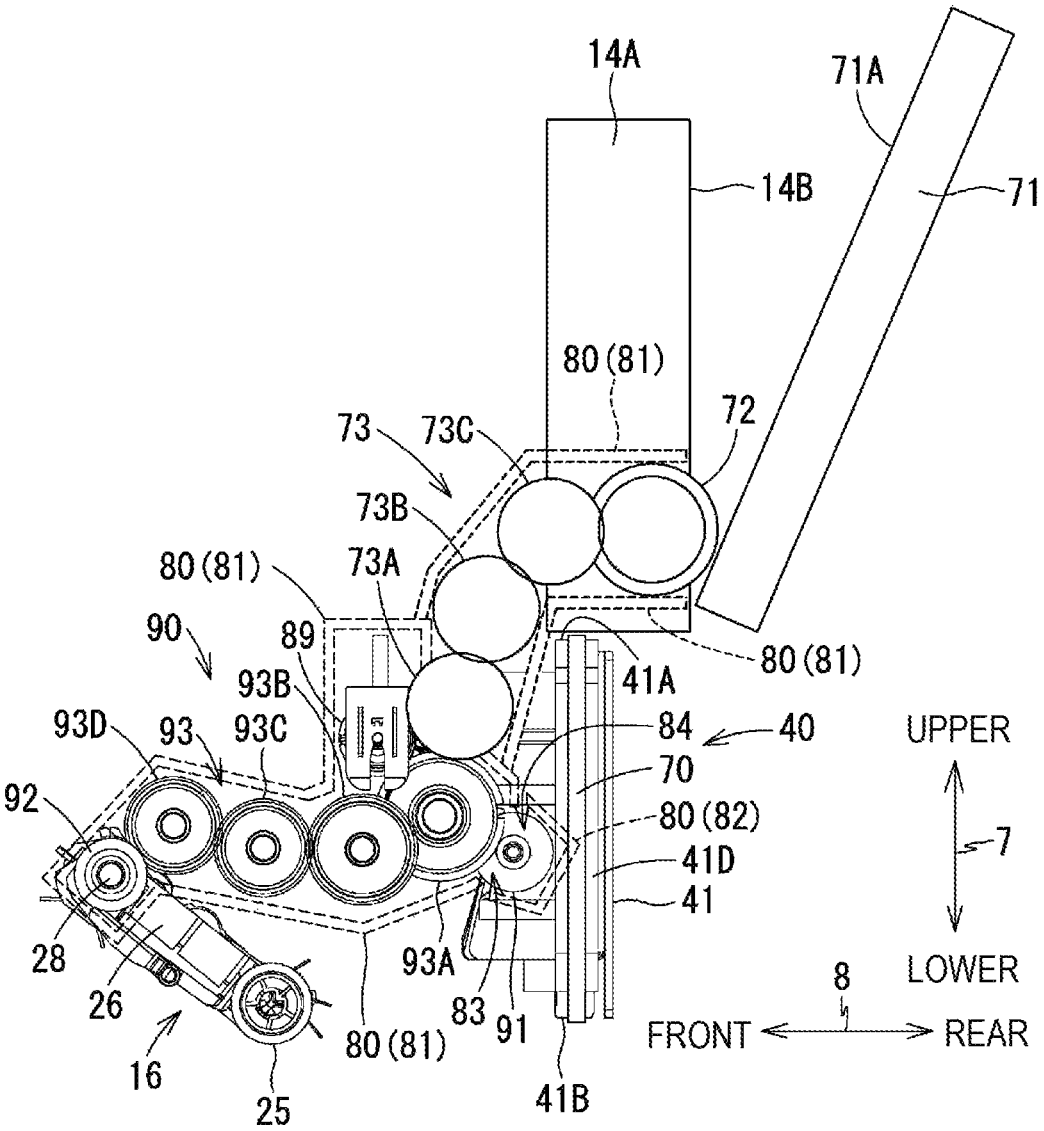
FIG. 12 is a left side view of the cover 40 located in the closed position, the drive transmission unit 90, the feeder unit 16 and the feeding tray 71.

In a configuration shown in FIG. 12, the drive transmission unit 90 includes a gear train 73 having three gears 73A, 73B and 73C. The roller 72 rotates by the drive force transmitted from the conveying motor 90 via the gear trains 93 and 73.

Note that, the number of gears of the gear train 73 is not limited to three. Also, in FIG. 12, the gear 73A is in mesh with the gear 93A of the gear train 93 but may also be in mesh with a gear other than the gear 93A. Also, the roller 72 may be attached to the feeding tray 71. Also, the roller 72 may be driven by a motor other than the conveying motor 89.

In the multifunction peripheral 10 shown in FIG. 9, the dust proofing part 70 is attached to a position in which a gap between the feeding tray 71 located in the first position and the attached part 14A of the printer housing 14 is filled, in addition to the position in which the gap between the cover 40 located in the closed position and the printer housing 14 is filled.

Note that, the feeding tray 71 may move to the first position and the second position by a manner other than the rotation. For example, the feeding tray 71 may move to the first position and the second position by attachment and detachment with respect to the attached part 14A.

Also, the roller may not be attached to the attached part 14A and the feeding tray 71. In this case, the sheet 15 is supported to the feeding tray 71 in a state where the sheet is in contact with the conveyor roller 61 inside of the housing 14 through the opening 14C, for example. Then, the sheet 15 is fed by the rotation of the conveyor roller 61.

The dust proofing part may be attached to the movement member.

If the dust proofing part is attached to the housing, the movement member may be caught at the dust proofing part while the movement member moves between the first position and the second position. In the present configuration, since the dust proofing part is attached to the movement member, it is possible to reduce occurrence of the above-described catching.

For example, the drive transmission unit may include: a gear configured to rotate coaxially and integrally with the roller: and a gear train engageable with the gear and configured to receive the drive force from the motor.

The roller and the gear may be attached to the movement member. The gear may be in mesh with the gear train in a state where the movement member is located in the first position.

In the configuration where the roller is attached to the movement member, like the present configuration, when the sheet is involved on the roller, the sheet can be taken out more easily by moving the movement member to the second position, as compared to a configuration where the roller is attached to the housing.

The sheet conveying device according to the present disclosure may further include a first covering part configured to cover a part of the gear train except an engaged part with the gear.

When the movement member is located in the second position, the sandy dust and the like are introduced into the housing. However, it is possible to reduce the attachment of the sandy dust and the like to the gear train by the first covering part.

The sheet conveying device according to the present disclosure may further include a second covering part configured to cover a part of the gear except an engaged part with the gear train.

When the movement member is located in the second position, the sandy dust and the like are introduced into the housing. However, it is possible to reduce the attachment of the sandy dust and the like to the gear by the second covering part.

The sheet conveying device according to the present disclosure may further include a covering part configured to cover the drive transmission unit.

When the movement member is located in the second position, the sandy dust and the like are introduced into the housing. However, it is possible to reduce the attachment of the sandy dust and the like to the drive transmission unit by the covering part.

For example, the movement member may be configured to move to the first position and the second position by attachment and detachment with respect to the housing.

For example, the movement member may be rotatably supported to the housing and is configured to move to the first position and the second position by rotation.

For example, the guide part may define the conveying path, and the movement member located in the second position exposes the inside of the housing to the outside of the housing.

For example, the movement member may be a tray configured to feed the sheet to the conveying path, and the guide part may be configured to support the sheet.

For example, the dust proofing part may be formed of a porous material.

The sandy dust and the like introduced into the dust proofing part should pass through a plurality of fine pores formed in the dust proofing part so as to enter from the outside to the inside of the housing. However, most of the sandy dust and the like are hindered from entering by the porous material walls among the plurality of fine pores, without passing through the plurality of fine pores. As a result, the sandy dust and the like can be suppressed from entering the inside of the housing.

Also, since the dust proofing part is formed of the porous material, the air can move between the outside and the inside of the housing. Thereby, in a state where the movement member is located in the second position, it is possible to suppress a situation where heat generated from the motor arranged inside of the housing is trapped inside of the housing and the temperature inside of the housing increases.

The present disclosure may be recognized as an image recording apparatus including the sheet conveying device, and a recording unit arranged inside of the housing and configured to record an image on the sheet that is conveyed along the conveying path.

What is claimed is:

1. A sheet conveying device comprising:

a housing in which a conveying path of a sheet is formed, a front surface of the housing having a first opening and a rear surface of the housing having a second opening;

a roller configured to convey the sheet by rotation;

a motor arranged inside of the housing;

a drive transmission configured to transmit a drive force of the motor to the roller; and a movement member comprising a guide configured to guide the sheet and at least a part of the drive transmission, the movement member being movable to a first position closing the inside of the housing with respect to an outside of the housing and a second position different from the first position, the movement member being configured to be attached and detached in a front and rear direction with respect to the housing, through the second opening;

a feeding tray configured to be inserted and pulled out in the front and rear direction with respect to the housing, through the first opening, and a dust proofing material attached to the movement member and to a position filling a gap between the movement member located in the first position and the housing.

2. The sheet conveying device according to claim 1, wherein the drive transmission comprises:

a gear configured to rotate coaxially and integrally with the roller; and a gear train engageable with the gear and configured to receive the drive force from the motor.

3. The sheet conveying device according to claim 2, wherein the roller and the gear are attached to the movement member, and wherein the gear is in mesh with the gear train in a state where the movement member is located in the first position.

4. The sheet conveying device according to claim 3, further comprising a first cover configured to cover a part of the gear train except an engaged part with the gear.

5. The sheet conveying device according to claim 3, further comprising a second cover configured to cover a part of the gear except an engaged part with the gear train.

6. The sheet conveying device according to claim 1, further comprising a covering part configured to cover the drive transmission.

7. The sheet conveying device according to claim 1, wherein the movement member is configured to move to the first position and the second position by attachment and detachment with respect to the housing.

8. The sheet conveying device according to claim 1, wherein the movement member is rotatably supported to the housing and is configured to move to the first position and the second position by rotation.

9. The sheet conveying device according to claim 1, wherein the guide defines the conveying path, and wherein the movement member located in the second position exposes the inside of the housing to the outside of the housing.

10. The sheet conveying device according to claim 1, wherein the movement member is a tray configured to feed the sheet to the conveying path, and wherein the guide is configured to support the sheet.

11. The sheet conveying device according to claim 1, wherein the dust proofing material is formed of a porous material.

12. An image recording apparatus comprising:

the sheet conveying device according to claim 1; and a recording device arranged inside of the housing and configured to record an image on the sheet that is conveyed along the conveying path.

* * * * *